United States Patent [19]

Seeley

[11] 4,104,483

[45] Aug. 1, 1978

[54] DEVICE SUITABLE FOR USE IN A RAILWAY RAIL-AND-FASTENING ASSEMBLY TO INSULATE A RAIL FROM A RAIL CLIP AND FROM AN ANCHORAGE FOR THE CLIP

[75] Inventor: David Ronald Seeley, Hertford, England

[73] Assignee: Pandrol Limited, London, England

[21] Appl. No.: 745,424

[22] Filed: Nov. 26, 1976

[51] Int. Cl.[2] ..... E01B 26/00; E01B 9/44; H01B 17/00

[52] U.S. Cl. ..... 174/138 R; 238/338; 238/349

[58] Field of Search ..... 174/138 R, 138 D; 238/107, 108, 152, 283, 310, 338, 349, 351

[56] References Cited

U.S. PATENT DOCUMENTS

| | | | |
|---|---|---|---|
| 3,004,716 | 10/1961 | Pande-Rolfsen | 238/349 |
| 3,080,120 | 3/1963 | Deturk | 238/283 X |
| 3,297,253 | 1/1967 | Astley et al. | 238/349 |
| 3,460,756 | 8/1969 | Sanson | 238/349 X |
| 3,463,394 | 8/1969 | Jones et al. | 238/338 |
| 3,610,526 | 10/1971 | Burwell | 238/349 X |
| 3,658,246 | 4/1972 | Davies | 238/349 |
| 3,700,167 | 10/1972 | Jennings et al. | 238/349 |

*Primary Examiner*—Laramie E. Askin
*Attorney, Agent, or Firm*—Haseltine, Lake & Waters

[57] ABSTRACT

A device suitable for use in a railway rail-and-fastening assembly to insulate a rail from a rail clip and from an anchorage for the clip includes an elongate plate-like portion, a portion depending from one side of it and two lugs projecting from the depending portion away from the plate-like portion near opposite ends thereof. In contrast to prior proposals, the device is asymetrical, a flat surface on the top of the plate-like portion having its center nearer one end of that portion than the other end. A ramp surface leads up to the flat surface from said other end. The device is preferably made wholly of glass fibre-reinforced nylon and the thickness of the plate-like portion is preferably at least 5 millimeters.

9 Claims, 3 Drawing Figures

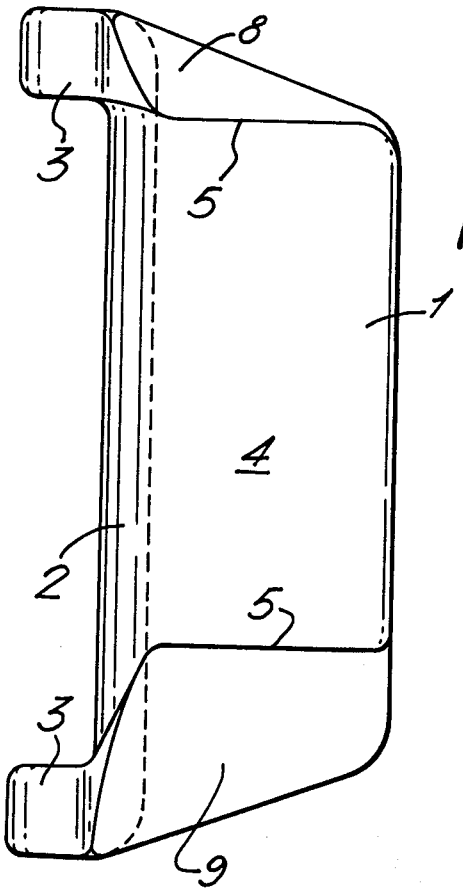
FIG.1.
FIG.2.
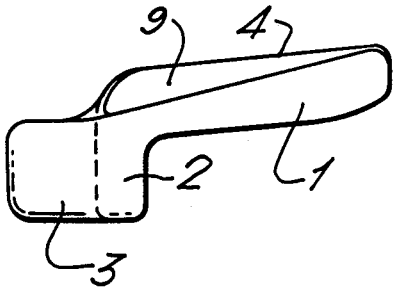
FIG.3.
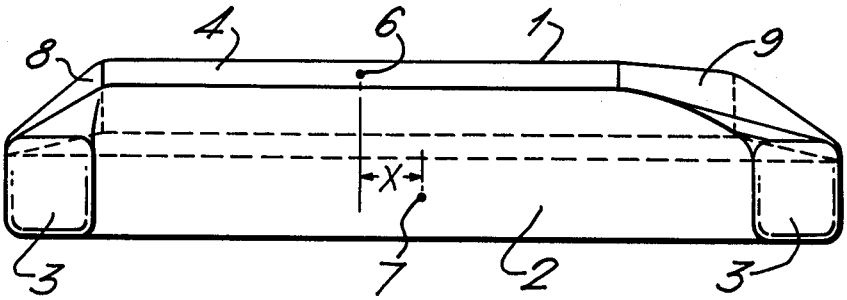

DEVICE SUITABLE FOR USE IN A RAILWAY RAIL-AND-FASTENING ASSEMBLY TO INSULATE A RAIL FROM A RAIL CLIP AND FROM AN ANCHORAGE FOR THE CLIP

BACKGROUND OF THE INVENTION

1. Field of the Invention

This invention relates generally to railway rail-and-fastening assemblies and particularly to a device suitable for use in such an assembly to electrically insulate a rail from a rail clip, which bears downwardly upon the upper surface of the rail flange, and from an anchorage, beside the rail flange, for the rail clip.

2. DESCRIPTION OF THE PRIOR ART

U.S. Pat. No. 3,004,716 (Pande-Rolfsen) discloses a rail clip made by bending a metal bar of circular cross-section. U.S. Pat. No. 3,297,253 (Astley et al) discloses a railway rail-and-fastening assembly in which a substantially straight leg of substantially the same clip is driven into a horizontal passageway through an anchorage, beside the rail flange, which is formed by the upper portion of a cast metal anchoring member, this portion projecting out of a concrete rail tie and another portion being embedded in the tie. Another portion of the clip bears downwardly upon the upper surface of the rail flange and a further portion of the clip bears downwardly upon the anchoring member at a location which, as seen from the rail, is beyond the passageway. It is desired to use the rail to carry electric currents for signalling purposes and since the concrete tie, the clip and the anchoring member are all good conductors of electricity the rail is electrically insulated from all of them by interposing a rubber pad between the top of the tie and the bottom of the rail flange and by using a one-piece elongate nylon insulator of substantially L-shaped cross-section, one limb of which is inclined to the horizontal and is interposed between the upper surface of the rail flange and the portion of the clip which bears downwardly upon that surface, whilst the other limb is vertical and is interposed between the edge of the rail flange and the anchoring member. Two lugs extend, from opposite ends of the vertical limb of the insulator, away from the other limb and they project on opposite sides of the anchoring member to limit movement of the insulator along the rail. Most of these insulators made to date have had the first-mentioned limb, i.e. the inclined limb, no more than about 4 millimeters thick. There is a tendency for the clip to sink into the insulator after a while, thus changing the geometry of the clip, and therefore the load which it exerts on the rail, and in extreme cases this has led to piercing of the insulator so that the clip directly contacted the rail. Several solutions to this problem have been proposed including increasing from the beginning the area of contact between clip and insulator by having a flat surface on the clip where it contacts the insulator — see U.S. Pat. No. 3,658,246 (Davies). Another solution was to make a composite device, for use in insulating a rail from a rail clip and from an anchorage for the clip, the device being in two parts, a metal part and a plastic part, each of substantially L-shaped cross-section and having an inclined limb and a vertical limb as described above, the clip bearing on the inclined limb of the metal part which bears on the inclined limb of the plastic part which bears on the upper surface of the rail flange — see U.S. Pat. No. 3,463,394 (Jones et al) for example. All the United States patents mentioned above have been assigned to a company to which my present invention is also assigned, a company which was formerly called Lockspike Limited but is now called Pandrol Limited.

South African Patent Application 75/6770 in the name of an associated company, Pandrol (Proprietary) Limited, discloses making the inclined limb of the one-piece insulator thicker than previously and making the insulator of glass fibre-reinforced plastic material. British Patent Application No. 44949/76, claiming priority from the South African application and in the name of Pandrol Limited, specifies that the thickness of the electrically insulating material of the inclined limb of the one-piece insulator should be more than 5mm., better more than 6mm., better still more than 7mm. and even better more than 8mm. and specifies that the insulator should be of fibre-reinforced plastic material, the fibre preferably being glass fibre and the plastic material preferably being nylon. None of the above ideas was conceived by me. In addition to these ideas my invention is disclosed in British application 44949/76 but not in South African application No. 75/6770.

SUMMARY OF THE INVENTION

According to my invention, there is provided a device for use in insulating a rail from a rail clip and from an anchorage for the clip comprising a first portion which is elongate and plate-like, a second portion depending from one side of the first portion and two lugs projecting from the second portion in the same direction as one another away from the first portion and near opposite ends thereof, said first portion comprising on its upper face a flat surface the centre of which is nearer to one end of said first portion than it is to the other end of said first portion, and said first portion further comprising a ramp surface leading up to said flat surface from said other end of the first portion.

Preferably, there is another and steeper ramp surface leading up to said flat surface from said one end of the first portion.

Prior to my invention, so far as I know, the insulating devices (i.e. one-piece and two-piece) have always been symmetrical with respect to a plane perpendicularly bisecting a straight line joining similar points on the sides of the two lugs which face one another. With my invention, however, the flat surface at the top of the first portion of the device is assymetrically placed, there being more of it on one side of the above-mentioned plane than on the other side. This corresponds to the usual assymetrical positioning of the area of contact between part of the fully driven clip and the device, i.e. further from that end of the first portion over which said part has passed in the driving operation than it is from the other end of the first portion. If the flat surface on the first portion of the device were to be symmetrically positioned and the thickness were to be increased substantially above 4 millimeters, for example to 8 millimeters, either the total length of the device would have to be increased, so that even more material would be required, or the ramp surface up which said part of the clip has to run would have to be very steep and the extra force which would have to be exerted on the device in the operation of driving the clip would entail a danger of one of the lugs shearing off.

It will thus be seen that my invention is especially useful in the case where the thickness of the electrically insulating material of the first portion is more than 4 millimeters but is not limited thereto. This thickness is preferably more than 5mm., better more than 6mm., better still more than 7mm. and even better more than 8mm. The material is preferably plastic material, advantageously nylon, reinforced with fibre, preferably glass fibre.

BRIEF DESCRIPTION OF THE DRAWINGS

FIG. 1 shows a plan view of a device for use in a railway rail-and-fastening assembly to insulate a rail from a rail clip and from an anchorage for the clip according to my invention, FIG. 2 shows an end elevation of the same, and FIG. 3 shows a side elevation of the same.

DETAILED DESCRIPTION OF THE DRAWINGS

The device shown is made wholly of glass fibre-reinforced nylon and is referred to below as an insulator, and is made by moulding such material in a single piece which includes an elongate, and in fact trapezoidal, first, plate-like, portion 1 for positioning on the flange of a railway rail which stands on an electrically insulating pad placed on an electrically conductive foundation for the rail, for example a concrete railway sleeper. It further includes a second portion 2 depending from one side of the first portion, the longer of the two parallel sides, for positioning between the edge of the rail flange and an anchorage for a rail clip, the anchorage being for example made of cast malleable iron with a portion embedded in the sleeper where the latter is of concrete. A rail clip, for example according to U.S. Pat. No. 3,658,246, has a substantially straight portion driven in a horizontal passageway in the anchorage, substantially parallel to the rail, another portion bearing downwardly on the upper side of the first portion 1 of the insulator and a further portion bearing downwardly on a part of the anchorage which, as seen from the rail, is beyond the passageway. The insulator electrically insulates the rail from the clip and from the anchorage. Two lugs 3 project from the second portion 2, in the same direction as one another away from the first portion 1 and near opposite ends thereof. In use of the insulator they project on opposite sides of the anchorage to limit movement of the insulator along the rail. The complete railway rail-and-fastening assembly is like that disclosed in U.S. Pat. No. 3,658,246 except that the insulator is thicker in the portions 1 and 2, it includes the glass fibre reinforcement and is assymetrical as explained below.

The insulator includes, on its face which is uppermost when it is in use, a rectangular flat surface 4, over the whole of which the thickness of the first portion 1 is 8mm, bounded at two opposite sides by the lines 5, the centre 6 of this flat surface being displaced, in the direction in which the rail extends when the insulator is in use, by a distance X from a point 7 midway between the lugs 3. Thus the centre of the flat surface 4 is nearer to that end of the first portion which is shown uppermost in FIG. 1 than it is to the other end of the first portion. There are a short and steep ramp surface 8 and a longer and less steep ramp surface 9 extending from opposite ends of the first portion up to the flat surface 4. Part of the clip rides up the ramp surface 9 in driving the clip into position. When fully driven, the area of contact between it and the insulator is substantially symmetrically positioned with regard to the length of the flat portion 4 of the insulator but not with regard to the length of the entire insulator.

I claim:

1. A device suitable for use in a railway rail-and-fastening assembly to insulate a rail from a rail clip and from an anchorage for the clip, comprising a single piece of fibre-reinforced plastic material, having a first portion which is elongate, trapezoidal and plate-like, with a thickness of at least 5mm., a second portion depending from one side of the first portion, and first and second lugs projecting from the second portion in the same direction as one another away from the first portion and near first and second ends, respectively, thereof, said first portion comprising on its upper face an elongate flat surface, the center of which is substantially nearer to said first end of said first portion than to said second end of said first portion, a first ramp surface leading up to said flat surface from said first end of said first portion, a second ramp surface leading up to said flat surface from said second end of said first portion, said first ramp surface having an angle from the horizontal substantially greater than the angle of said second ramp surface from the horizontal with said second ramp surface angle being small enough to permit the driving of the clip onto said flat surface without shearing off the second lug.

2. A device suitable for use in a railway rail-and-fastening assembly to insulate a rail from a rail clip and from an anchorage for the clip, comprising a first portion which is elongate and plate-like, said first portion having first and second ends, a second portion depending from one side of the first portion, and two lugs projecting from the second portion in the same direction as one another away from the first portion and near opposite ends thereof, said first portion comprising on its upper face a flat surface, the center of which is substantially nearer to said first end of said first portion than to said second end of said first portion, a first ramp surface leading up to said flat surface from said first end of said first portion, a second ramp surface leading up to said flat surface from said second end of said first portion, said first ramp surface having an angle from the horizontal substantially greater than the angle of said second ramp surface from the horizontal with said second ramp surface angle being small enough to permit the driving of the clip onto said flat surface without shearing off the second lug.

3. A device according to claim 2 in which the thickness of the electrically insulating material in the first portion is more than 5 millimeters.

4. A device according to claim 2 in which the thickness of the electrically insulating material in the first portion is more than 6 millimeters.

5. A device according to claim 2 in which the thickness of the electrically insulating material in the first portion is more than 7 millimeters.

6. A device according to claim 2 in which the thickness of the electrically insulating material in the first portion is more than 8 millimeters.

7. A device according to claim 2 made wholly of fibre-reinforced plastic material.

8. A device according to claim 7 in which the plastic material is nylon.

9. A device according to claim 7 in which the fibre is glass fibre.

* * * * *